US011073344B2

(12) United States Patent
Williams et al.

(10) Patent No.: US 11,073,344 B2
(45) Date of Patent: Jul. 27, 2021

(54) HEAT EXCHANGER TUBES

(71) Applicant: Rheem Manufacturing Company, Atlanta, GA (US)

(72) Inventors: Kevin Williams, Oxnard, CA (US); Amin Akbarimonfared, Oxnard, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 77 days.

(21) Appl. No.: 16/393,236

(22) Filed: Apr. 24, 2019

(65) Prior Publication Data

US 2020/0340760 A1 Oct. 29, 2020

(51) Int. Cl.

| | |
|---|---|
| ***F28F 1/42*** | (2006.01) |
| ***F28F 1/06*** | (2006.01) |
| ***F28F 1/00*** | (2006.01) |
| *F28F 1/02* | (2006.01) |

(52) U.S. Cl.

CPC ..... *F28F 1/426* (2013.01); *F28F 1/006* (2013.01); *F28F 1/06* (2013.01); *F28F 2001/027* (2013.01)

(58) Field of Classification Search

CPC ..... F28F 1/08; F28F 1/426; F28F 2001/027; F28F 13/08; F28F 13/12; F28F 1/006; F28F 1/06; F28F 1/025

See application file for complete search history.

(56) References Cited

U.S. PATENT DOCUMENTS

| | | | | |
|---|---|---|---|---|
| 1,922,838 | A | 8/1933 | Bossart | |
| 3,230,936 | A * | 1/1966 | Cleaver | F22B 7/12 122/149 |
| 3,757,856 | A | 9/1973 | Kun | |
| 5,839,505 | A * | 11/1998 | Ludwig | F28F 13/08 165/109.1 |
| 5,844,333 | A * | 12/1998 | Sheerin | F28F 1/08 310/52 |
| 6,688,378 | B2 | 2/2004 | O'Donnell et al. | |
| 7,255,155 | B2 | 8/2007 | O'Donnell et al. | |
| 8,459,342 | B2 | 6/2013 | O'Donnell et al. | |
| 2001/0052411 | A1 * | 12/2001 | Pantow | F28F 1/422 165/152 |

(Continued)

FOREIGN PATENT DOCUMENTS

| | | |
|---|---|---|
| WO | WO 2017007354 | 1/2017 |
| WO | WO 2017007355 | 1/2017 |

*Primary Examiner* — Eric S Ruppert
*Assistant Examiner* — Hans R Weiland
(74) *Attorney, Agent, or Firm* — Troutman Pepper Hamilton Sanders LLP

(57) ABSTRACT

A tube for a thermal transfer device can include a wall having a length and having an inner surface and an outer surface, wherein the inner surface forms a cavity. The tube can also include at least one first dimple pressed into the wall toward the cavity at a first location along the length of the wall, where the inner surface of the wall at the at least one first dimple is separated from itself by a first distance. The tube can further include at least one second dimple pressed into the wall toward the cavity at a second location along the length of the wall, where the inner surface of the wall at the at least one second dimple is separated from itself by a second distance. The cavity can be configured to receive a fluid that flows continuously along a length of the at least one wall.

20 Claims, 8 Drawing Sheets

(56) References Cited

U.S. PATENT DOCUMENTS

| | | | | |
|---|---|---|---|---|
| 2007/0089873 | A1* | 4/2007 | Beste | F28F 1/426<br>165/177 |
| 2010/0139631 | A1* | 6/2010 | Geskes | F28F 13/12<br>123/568.12 |
| 2010/0224349 | A1* | 9/2010 | Hirokawa | F28F 1/426<br>165/177 |
| 2019/0017753 | A1* | 1/2019 | Plummer | F28F 1/06 |
| 2019/0186431 | A1* | 6/2019 | Koch | F28F 13/08<br>165/109.1 |

* cited by examiner

HEAT EXCHANGER TUBES

TECHNICAL FIELD

Embodiments described herein relate generally to heat exchangers, and more particularly to configurations of heat exchanger (HX) tubes and tube assemblies for heat exchangers.

BACKGROUND

Heat exchangers, boilers, combustion chambers, water heaters, and other similar devices (generally called heat exchangers or vessels herein) control or alter thermal properties of one or more fluids. In some cases, tubes (also called heat exchanger tubes or HX tubes) disposed within these devices are used to transfer a fluid through a volume of space, thereby altering the thermal properties of the fluid. The temperature of the fluid can increase or decrease, depending on how the device is configured.

SUMMARY

In general, in one aspect, the disclosure relates to a tube for a thermal transfer device. The tube can include a wall having a length and also having an inner surface and an outer surface, where the inner surface forms a cavity. The tube can also include at least one first dimple pressed into the wall toward the cavity at a first location along the length of the wall, where the inner surface of the wall at the at least one first dimple is separated from itself by a first distance. The tube can further include at least one second dimple pressed into the wall toward the cavity at a second location along the length of the wall, where the inner surface of the wall at the at least one second dimple is separated from itself by a second distance. The cavity can be configured to receive a fluid that flows continuously along a length of the wall. The first distance can be greater than the second distance.

These and other aspects, objects, features, and embodiments will be apparent from the following description and the appended claims.

BRIEF DESCRIPTION OF THE DRAWINGS

The drawings illustrate only example embodiments of HX tubes and are therefore not to be considered limiting in scope, as HX tubes may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1B:
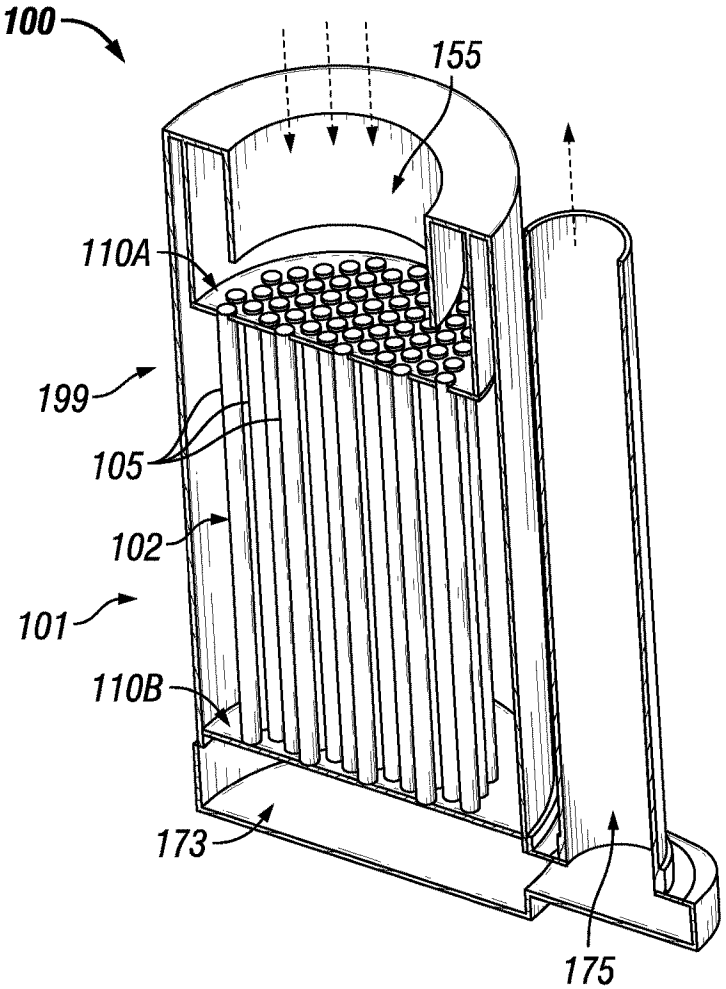
FIG. 1B (Prior Art)
FIGS. 1A and 1B show a prior art boiler in which the example embodiments of HX tubes as described herein can be implemented.

The example embodiments discussed herein are directed to systems, methods, and devices for HX tubes. Example embodiments can be directed to any of a number of thermal transfer devices, including but not limited to boilers, condensing boilers, heat exchangers, furnaces, and water heaters. Further, one or more of any number of fluids can flow through example HX tubes. Examples of such fluids can include, but are not limited to, water, heated air, deionized water, steam, combustion gases, glycol, and dielectric fluids.

Example embodiments can be pre-fabricated or specifically generated (e.g., by shaping a malleable body) for a particular heat exchanger and/or environment. Example embodiments can have standard or customized features (e.g., shape, size, features on the inner surface, pattern, configuration). Therefore, example embodiments described herein should not be considered limited to creation or assembly at any particular location and/or by any particular person.

The HX tubes (or components thereof) described herein can be made of one or more of a number of suitable materials and/or can be configured in any of a number of ways to allow the HX tubes (or devices (e.g., boiler, heat exchanger) in which the HX tubes are disposed) to meet certain standards and/or regulations while also maintaining reliability of the HX tubes, regardless of the one or more conditions under which the HX tubes can be exposed. Examples of such materials can include, but are not limited to, aluminum, stainless steel, ceramic, fiberglass, glass, plastic, and rubber.

As discussed above, heat exchangers can be subject to complying with one or more of a number of standards, codes, regulations, and/or other requirements established and maintained by one or more entities. Examples of such entities can include, but are not limited to, the American Society of Mechanical Engineers (ASME), the Tubular Exchanger Manufacturers Association (TEMA), the American Society of Heating, Refrigeration and Air Conditioning Engineers (ASHRAE), Underwriters' Laboratories (UL), the National Electric Code (NEC), the Institute of Electrical and Electronics Engineers (IEEE), and the National Fire Protection Association (NFPA). Example HX tubes allow a heat exchanger to continue complying with such standards, codes, regulations, and/or other requirements. In other words, example HX tubes, when used in a heat exchanger, do not compromise compliance of the heat exchanger with any applicable codes and/or standards.

Any example HX tubes, or portions thereof, described herein can be made from a single piece (e.g., as from a mold, injection mold, die cast, 3-D printing process, extrusion process, stamping process, crimping process, and/or other prototype methods). In addition, or in the alternative, example HX tubes (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As described herein, a user can be any person that interacts with HX tubes or heat exchangers in general. Examples of a user may include, but are not limited to, an engineer, a maintenance technician, a mechanic, an employee, a visitor, an operator, a consultant, a contractor, and a manufacturer's representative. Components (e.g., a smooth metal protrusion) and/or features (e.g., dimples) described herein can be used to deform a HX tube, thereby making the cavity formed by the HX tube non-cylindrical.

If a component (e.g., a protruding feature) is added to a HX tube to alter the cylindrical shape of the cavity formed by the HX tube, such component can be coupled to an inner surface of the HX tube using one or more of a number of coupling features. As used herein, a "coupling feature" can couple, secure, fasten, abut, and/or perform other functions aside from merely coupling.

A coupling feature as described herein can allow one or more components (e.g., a protruding feature) of a HX tube to become coupled, directly or indirectly, to another portion (e.g., an inner surface) of the HX tube. A coupling feature can include, but is not limited to, a snap, a clamp, a portion of a hinge, an aperture, a recessed area, a protrusion, a slot, a spring clip, a tab, a detent, a compression fitting, and mating threads. One portion of an example HX tube can be coupled to a component (e.g., a diffuser plate) of a heat exchanger and/or another portion of the HX tube by the direct use of one or more coupling features.

In addition, or in the alternative, a portion of an example HX tube can be coupled to another component of a heat exchanger and/or another portion of the HX tube using one or more independent devices that interact with one or more coupling features disposed on a component of the HX tube. Examples of such devices can include, but are not limited to, a weld, a pin, a hinge, a fastening device (e.g., a bolt, a screw, a rivet), epoxy, adhesive, and a spring. One coupling feature described herein can be the same as, or different than, one or more other coupling features described herein. A complementary coupling feature as described herein can be a coupling feature that mechanically couples, directly or indirectly, with another coupling feature.

Any component described in one or more figures herein can apply to any other figures having the same label. In other words, the description for any component of a figure can be considered substantially the same as the corresponding component described with respect to another figure. The numbering scheme for the components in the figures herein parallel the numbering scheme for corresponding components described in another figure in that each component is a three digit number and corresponding components have identical last two digits. For any figure shown and described herein, one or more of the components may be omitted, added, repeated, and/or substituted. Accordingly, embodiments shown in a particular figure should not be considered limited to the specific arrangements of components shown in such figure.

Example embodiments of HX tubes will be described more fully hereinafter with reference to the accompanying drawings, in which example embodiments of HX tubes are shown. HX tubes may, however, be embodied in many different forms and should not be construed as limited to the example embodiments set forth herein. Rather, these example embodiments are provided so that this disclosure will be thorough and complete, and will fully convey the scope of HX tubes to those of ordinary skill in the art. Like, but not necessarily the same, elements (also sometimes called components) in the various figures are denoted by like reference numerals for consistency.

Terms such as "first," "second," "top," "bottom," "left," "right," "end," "back," "front," "side", "rear", "length," "width," "inner," "outer," "above", "lower", and "upper" are used merely to distinguish one component (or part of a component or state of a component) from another. Such terms are not meant to denote a preference or a particular orientation, and such terms are not meant to limit embodiments of HX tubes. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1A:
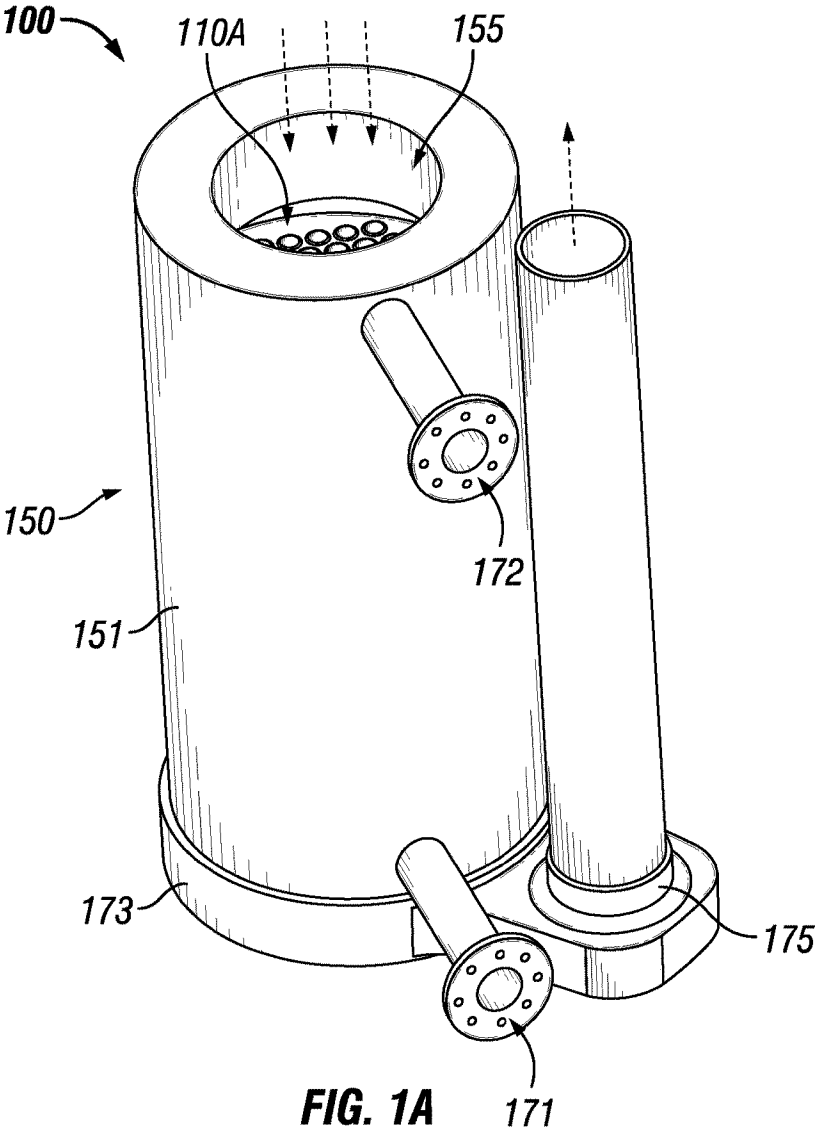
FIG. 1A (Prior Art)

FIGS. 1A and 1B show a boiler 100 with a prior art tube assembly of HX tubes which can be replaced with the example embodiments of HX tubes described herein. Specifically, FIG. 1A shows a perspective view of the boiler 100, and FIG. 1B shows a cross-sectional perspective view of the boiler 100. Referring to FIGS. 1A and 1B, the boiler 100 includes one or more of any number of components. For example, in this case, the boiler 100 includes at least one wall 151 that forms a cavity 155. Toward the bottom of the boiler is a flue gas collection chamber 173 that provides a bridge between the cavity 155 of the boiler 100 and an exhaust vent 175. Disposed within the cavity 155 in this case are two diffuser plates 110 (top diffuser plate 110A and bottom diffuser plate 110B) and a number of HX tubes 105 disposed between the diffuser plates 110. The two diffuser plates 110 can be called a diffuser assembly 199. The group of tubes 105 can be called a tube assembly 102. The combination of the diffuser assembly 199 and the tube assembly 102 can be called an assembly 101.

The boiler 100 uses a mixture of a gaseous fuel (e.g., natural gas, propane, butane) and air (premixed) to transfer heat to a fluid (e.g., water), and the heated fluid (e.g., water, steam, liquids, gases) can be used for some other process or purpose. In some cases, the fuel can be premixed with some other component, such as air. For example, the fuel/air mixture can be introduced into the top of the boiler 100, as shown at the top of FIGS. 1A and 1B. Once inside the top part of the cavity 155, there can be some heat source (e.g., a burner, and ignitor) that raises the temperature of the fuel/air mixture, resulting in combustion and burning of the fuel/air mixture. From there, the resulting hot gases (byproducts of the combustion of the fuel/air mixture) can be directed into the various HX tubes 105 and travel down those HX tubes 105 to the collection chamber 173. The hot gases then continue on to the exhaust vent 175 and leave the boiler 100. The water vapor in the combustion products can either be in the vapor phase (non-condensing mode) or in the liquid phase (condensing mode), depending on the design of the boiler 100.

As stated above, example embodiments of HX tubes can be used in other types of applications and/or thermal transfer devices (e.g., furnaces). Such other applications may have no combustion involved. As such, the fluid that flows through an example HX tube can be one or more of any type of liquid, gas, or combination thereof. Similarly, the fluid that surrounds an example HX tube can be one or more of any type of liquid, gas, or combination thereof.

At the same time another fluid (e.g., water) is brought into the bottom part of the boiler 100 through the inlet 171. Once inside the cavity 155, the fluid comes into contact with the outer surfaces of the HX tubes 105. In many cases, the HX tubes 105 are made of a thermally conductive material. In this way, when the hot gases (from the combustion process) travel down the HX tubes 105, some of the heat from the fuel is transferred to the walls of the HX tubes 105. Further, as the fluid comes into contact with the outer surface of the walls of the HX tubes 105, some of the heat captured by the walls of the tubes HX 105 from the heated fuel is transferred to the fluid in the cavity 155. The heated fluid is drawn up toward the top of the cavity 155 of the boiler 100, and the heated fluid is then drawn out of the boiler 100 through the outlet 172. The heated fluid can then be used for one or more other processes, such as space heating and hot water for use in a shower, a clothes washing machine, a dishwashing machine, and/or some other appliance that uses hot water.

The HX tubes 105 are held in place within the cavity 155 of the boiler by tube sheets and the diffuser plates 110. The diffuser plates 110 can be coupled to an interior surface (e.g., disposed in a recess of an inner surface of the wall 151) of the boiler 100. Although the major role of the diffuser plates 110 is to redirect the flow and to make the flow uniform inside the cavity 155 and around the HX tubes 105, from a structural point of view, the diffuser plates 110 can also be used, in conjunction with tube sheets, to maintain the position of the tubes HX 105 within the cavity 155.

Figure 2:
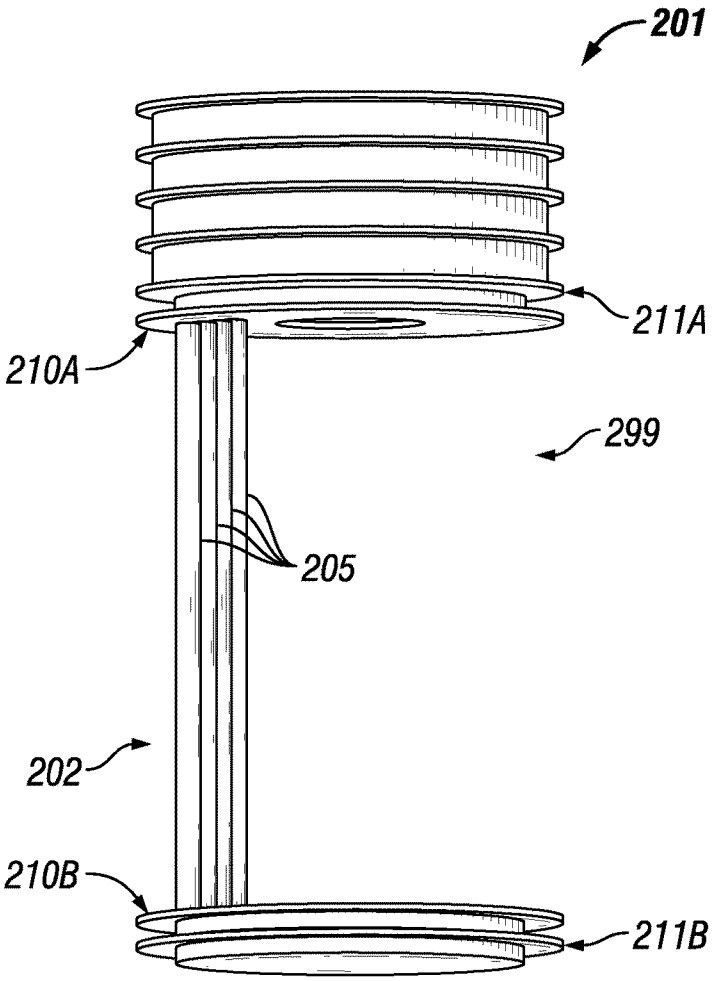
FIG. 2 (Prior Art)
FIG. 2 shows a subassembly for a boiler as currently used in the art.

FIG. 2 shows a subassembly 201 for a boiler currently used in the art. Referring to FIGS. 1A through 2, the subassembly 201 includes two diffuser plates 210, with a top diffuser plate 210A being disposed near the top end of the HX tubes 205 close to a top tube sheet 211A, and with the bottom diffuser plate 210B being disposed near the bottom end of the HX tubes 205 close to a bottom tube sheet 211B. The HX tubes 205 collectively form a tube assembly 202.

As can be seen in FIG. 2, the outer surface of the HX tubes 205 used in the current art is cylindrical in shape, with no curvature, dimples, or other similar protruding features. Further, the inner surface of the HX tubes 205 that form the cavity through which the hot gases travel is also cylindrical (tubular, with no features) as currently used in the art.

Figure 3A:
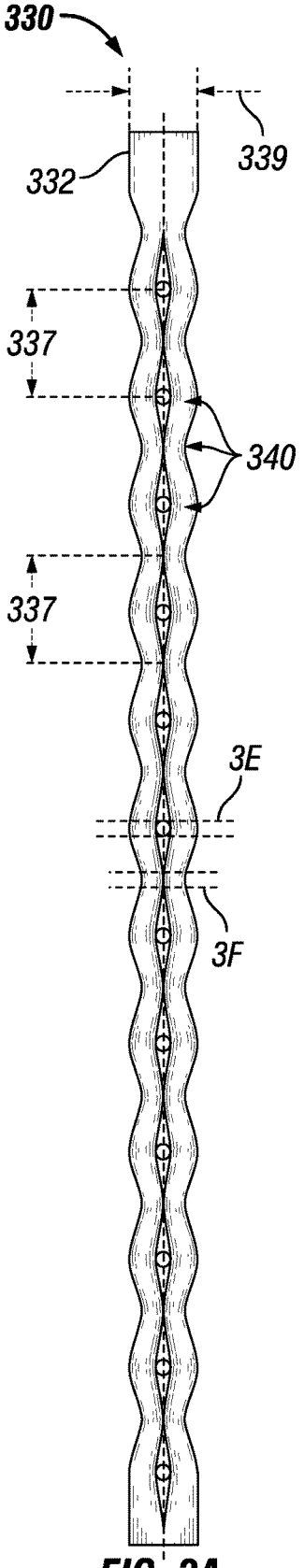
FIG. 3A (Prior Art)
FIGS. 3A through 3F show various views of HX tubes as currently used in the art.
Figure 3B:
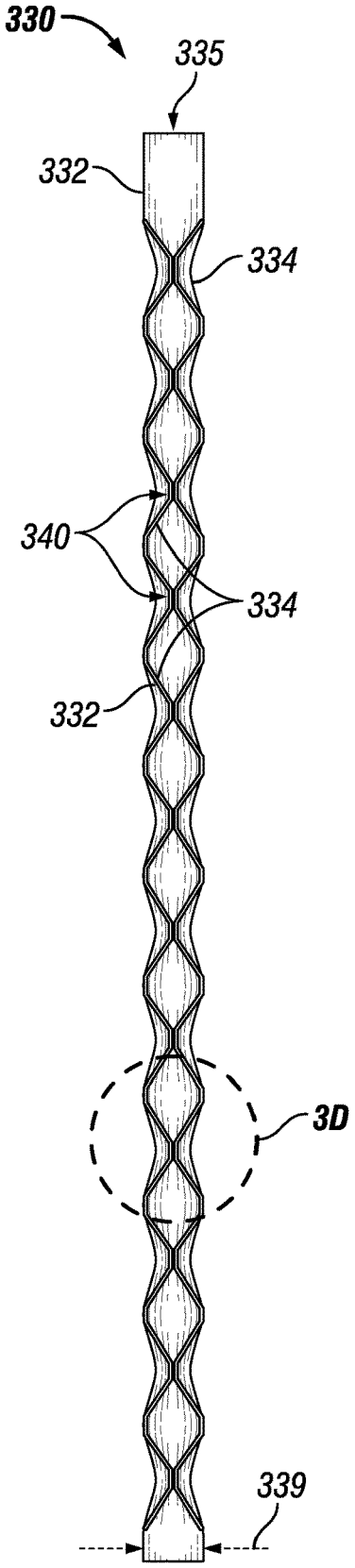
FIG. 3B (Prior Art)
Figure 3C:
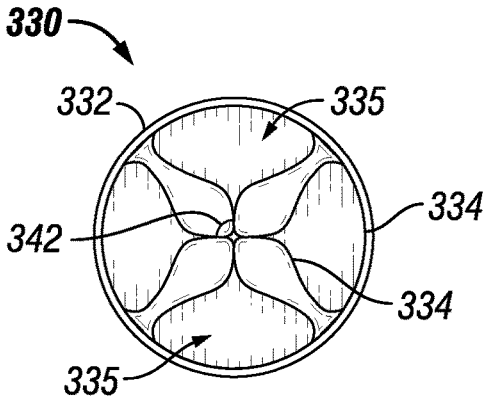
FIG. 3C (Prior Art)
Figure 3D:
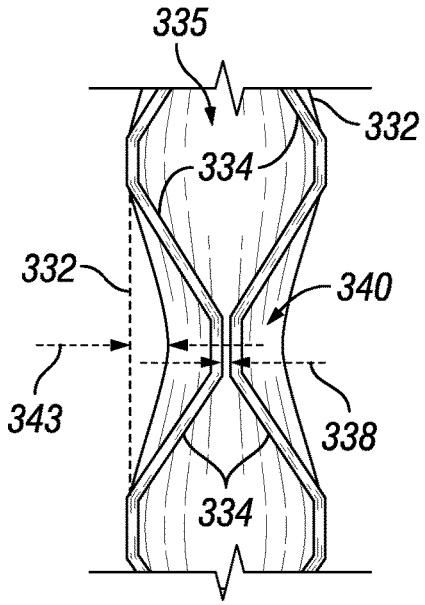
FIG. 3D (Prior Art)
Figure 3E:
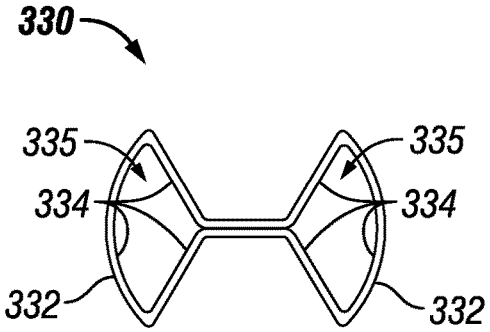
FIG. 3E (Prior Art)
Figure 3F:
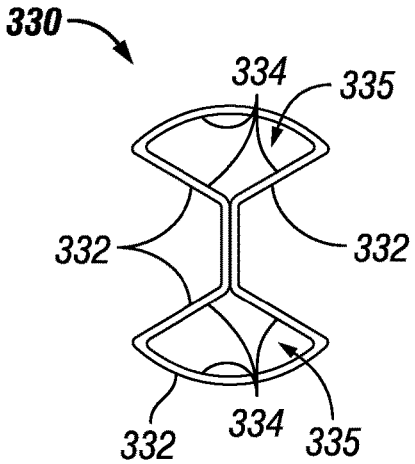
FIG. 3F (Prior Art)

FIGS. 3A through 3F show various views of a HX tube 330 currently used in the art. Specifically, FIG. 3A shows a side view of the HX tube 330. FIG. 3B shows a cross-sectional side view of the HX tube 330. Specifically, FIG. 3C shows a semi-transparent top view of the HX tube 330. FIG. 3D shows a detailed view of FIG. 3B. FIG. 3E shows a top view of a cross-sectional segment of the HX tube 330. FIG. 3F shows a top view of another cross-sectional segment of the HX tube 330.

Referring to FIGS. 1A through 3F, the HX tube 330 starts out with a cylindrical shape, as shown with the HX tubes 105 of FIG. 1B and the HX tubes 205 of FIG. 2. However, according to certain example embodiments, the HX tube 330 of FIGS. 3A-3F, having outer diameter 339, undergoes one or more processes (e.g., crimping, twisting, bending) so that the HX tube 330 (and, more specifically, the inner surface 334 of the HX tube 330) is non-cylindrical. In other words, while the cavities formed by the inner surface of the HX tubes 105 of FIG. 1B and the HX tubes 205 of FIG. 2 are cylindrical, the cavity 335 formed by the inner surface of an example HX tube (e.g., HX tube 330) is not cylindrical.

In this case, the HX tube 330 has an inner surface 334 (also called an inner wall surface 334) and an outer surface 332 (also called an outer wall surface 332). At regular intervals (denoted by distances 337 in FIG. 3A), a number of crimps are made in the HX tube 330, creating a number of dimples 340 (a type of protruding feature relative to the cavity 335). The dimples 340 on the HX tube 330 are simultaneously created on opposing sides of the HX tube 330, creating a mirror image of inward dimples 340, as shown in FIGS. 3E and 3F. These dimples 340 can be made so far inward that the inner surface 334 of the HX tube 330 makes contact with itself, as shown in FIGS. 3E and 3F, at the location in the cavity 335 where the dimples 340 are formed.

Alternatively, as shown in FIG. 3D, there can be a gap 338 that separates the inner surface 334 from itself at the location in the cavity 335 where the dimples 340 are formed. Alternatively, the dimples 340 can approach each other within the cavity 335 without making physical contact with each other. Regardless, in the current art, pairs of dimples 340 used in HX tubes 330 have the same width along the entire length of the HX tube 330. In other words, for example, if one pair of opposing dimples 340 disposed in a HX tube 330 make contact with each other, then all pairs of dimples 340 along the entire length of the HX tube 330 make contact with each other. As another example, if one pair of opposing dimples 340 disposed in a HX tube 330 are separated by a gap 338 (also called a distance 338) of 0.25 inches, then all pairs of dimples 340 along the entire length of the HX tube 330 are separated by a gap 338 of 0.25 inches.

As yet another alternative, rather than two opposing dimples 340 at a particular location along the length of the HX tube 340, there can be a single dimple 340 or three or more dimples 340 formed at such a location along the length of the HX tube 340. In such a case, the inner surface 334 can contact itself as a result of the dimple 340, or there can be a gap 338 between the inner surfaces 334 where the dimple 340 is formed. Within a HX tube 340, the gap 338 between pairs of opposing dimples 340 can be the same as, or be different than, the gap 338 between one or more other pairs of opposing dimples 340. As stated above, in the current art, all of the gaps 338 within the HX tube 340 are the same along the length of the HX tube 330.

In any case, regardless of the number of dimples 340 or whether the inner surface 334 contacts itself at a location where the one or more dimples 340 are formed, the dimples 340 do not completely close off the cavity 335. In other words, the cavity 335 is continuous along the length of the HX tube 330, although in some locations (e.g., where the dimples 340 are formed) of the HX tube 330, the cavity 335 is smaller relative to other locations (e.g., where no dimples 340 are formed) of the HX tube 330.

As discussed above, opposing pairs of dimples 340 in FIGS. 3A through 3F are created at regular intervals 337 along the length of the HX tube in a top-bottom (when viewed from above) orientation. In addition, opposing pairs of dimples 340 in FIGS. 3A through 3F are created at regular intervals 337 along the length of the HX tube in a left-right (when viewed from above) orientation. The left-right oriented dimples 340 are also equally spaced along the length of the HX tube 330 relative to the adjacent top-bottom oriented dimples 340. In other words, one pair of dimples 340 can be rotated 90 degrees (or any other degrees) about the longitudinal axis of the HX tube 330 relative to an adjacent pair of dimples 340.

In other words, the left-right oriented dimples 340 are separated from the adjacent top-bottom oriented dimples 340 along the length of the HX tube 330 by a distance equal to half of distance 337. Alternatively, the distance 337 between adjacent top-bottom oriented dimples 340, the distance 337 between adjacent left-right oriented dimples 340, and/or the distance between adjacent top-bottom oriented dimples 340 and left-right oriented dimples 340 along the length of the HX tube 330 can vary.

When adjacent dimples 340 along the length of the HX tube 330 have a different orientation (e.g., left-right followed by top-bottom) with respect to each other, a dimple angle 342 (also called a protruding feature angle 342) can be formed. In this example, the dimple angle is approximately 90°. The dimple angle can be any other angle, including but not limited to an acute angle, an obtuse angle, and 0°. Further, the dimple angle between one set of adjacent dimples 340 along the length of the HX tube 330 can be substantially the same as, or different than, the dimple angle between another set of adjacent dimples 340 along the length of the HX tube 330.

When there are multiple dimples 340 along a horizontal slice of the HX tube 330, those dimples 340 can meet at or converge toward any point within the cavity 335. For example, as shown in FIGS. 3C through 3F, the dimples 340 can converge toward or meet at, as the case may be, the center of the cavity 335 when viewed from above. Further, when dimples 340 are formed in the HX tube 330, the slope at which the dimple 340 is made can vary. In other words, the amount of the outer surface 332 of the HX tube that is affected (e.g., bent inward) by a dimple 340 can vary.

This slope of a dimple 340 can be measured in one or more of a number of ways. For example, as shown in FIG. 3D, the slope can be determined by viewing the dimple from the side and measuring the distance 343 between the outer surface 332 formed by the dimple 340 and where the outer surface 332 would have been without the dimple 340. Any or all of the factors and characteristics of a dimple 340, such as those described herein, can be controlled to generate a desired effect regarding the flow of a fluid through the cavity 335 and reduced pressure drop along the length of the HX tube 330.

The design shown in FIGS. 3A through 3F is commonly used in the art so that fluids (e.g., hot gases that are byproducts of the combustion of the fuel/air mixture in the heat exchanger) that flow through the cavities 335 of the HX tubes 330 can be better controlled. However, by having the gaps 338, if any, be uniform along the entire length of the HX tube 330, the velocity of the fluid traveling through the cavity 335 can lack uniformity, and the pressure drop of the fluid along the length of the cavity 335 can be suboptimal. As a result, the temperature distribution across and along the HX tube 330 shown in FIGS. 3A through 3F can be poor and non-uniform.

Figure 4B:
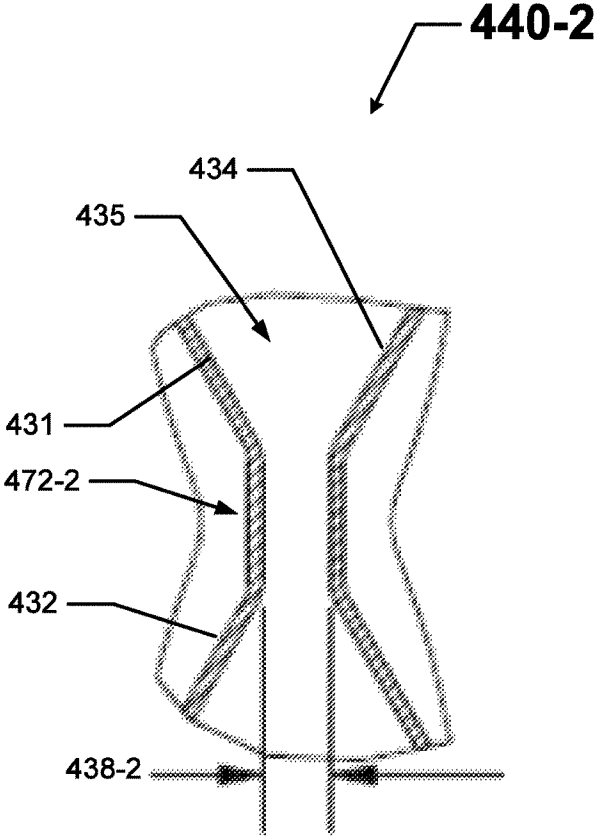
FIGS. 4A through 4D show various views of a HX tube in accordance with certain example embodiments.
Figure 4A:
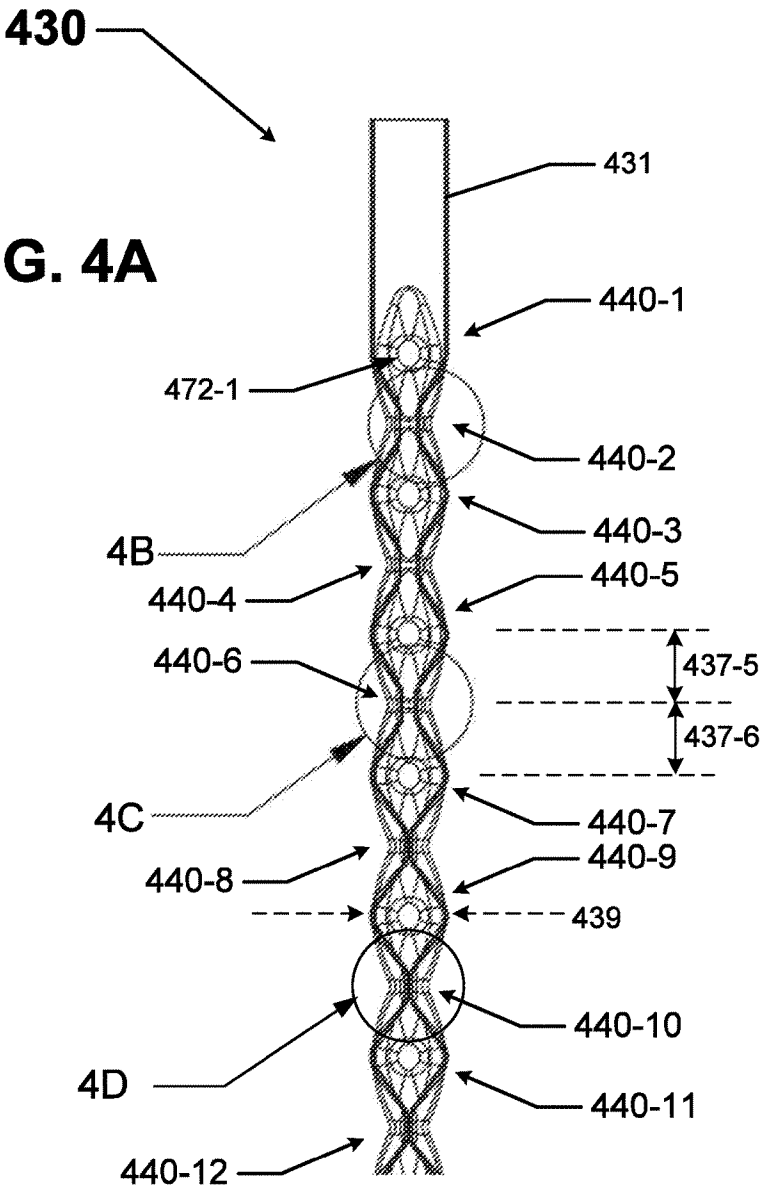
Figure 4D:
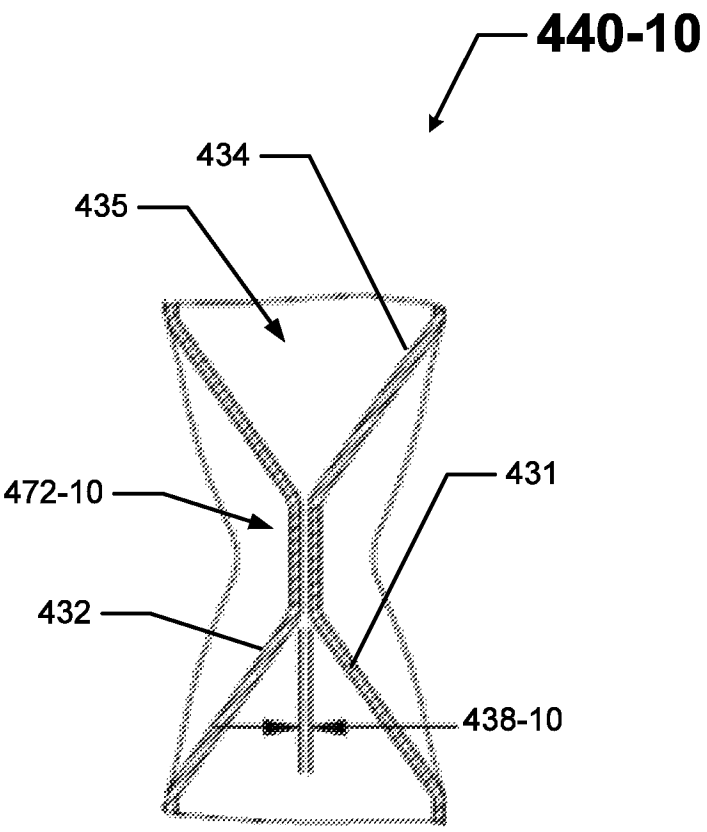
Figure 4C:
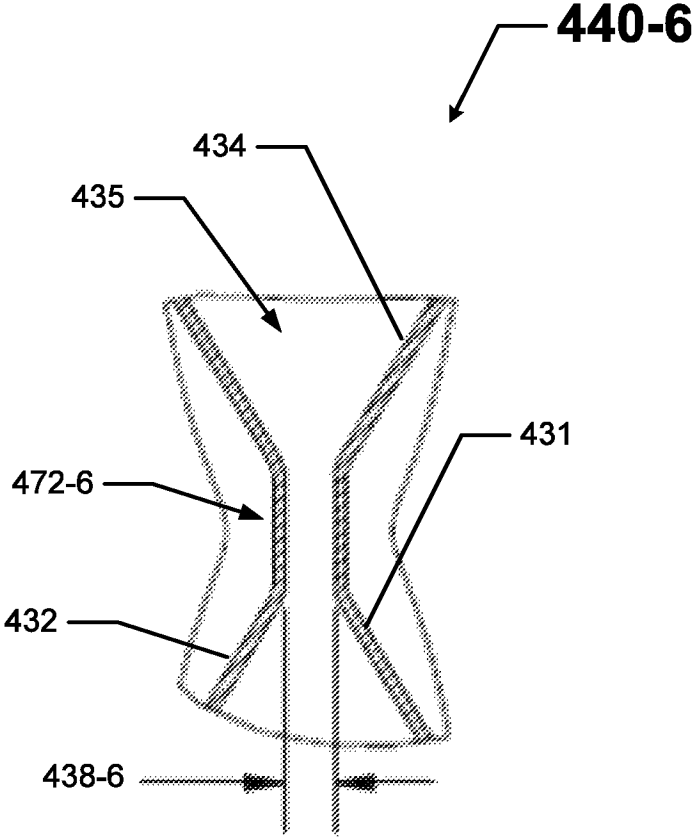

FIGS. 4A through 4D show various views of a HX tube 430 in accordance with certain example embodiments. Specifically, FIG. 4A shows a side view of a portion of a HX tube 430. FIG. 4B shows a cross-sectional side view of a dimple set 440-2 of the HX tube 430 of FIG. 4A. FIG. 4C shows a cross-sectional side view of another dimple set 440-6 of the HX tube 430 of FIG. 4A. FIG. 4D shows a cross-sectional side view of yet another dimple set 440-10 of the HX tube 430 of FIG. 4A.

Figure 5A:
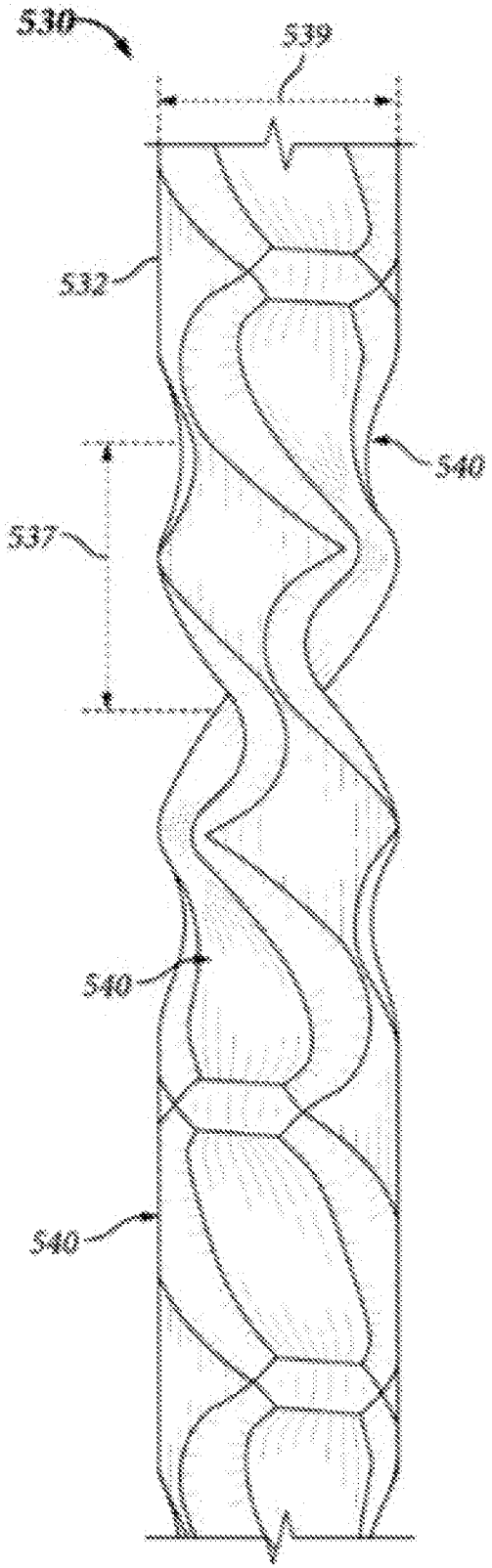
FIGS. 5A and 5B show various views of another HX tube in accordance with certain example embodiments.
Figure 5B:
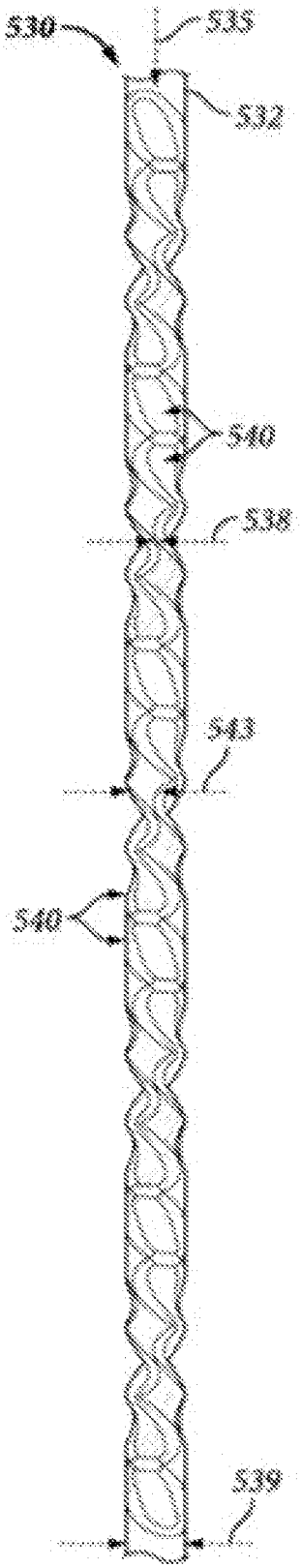
Figure 6B:
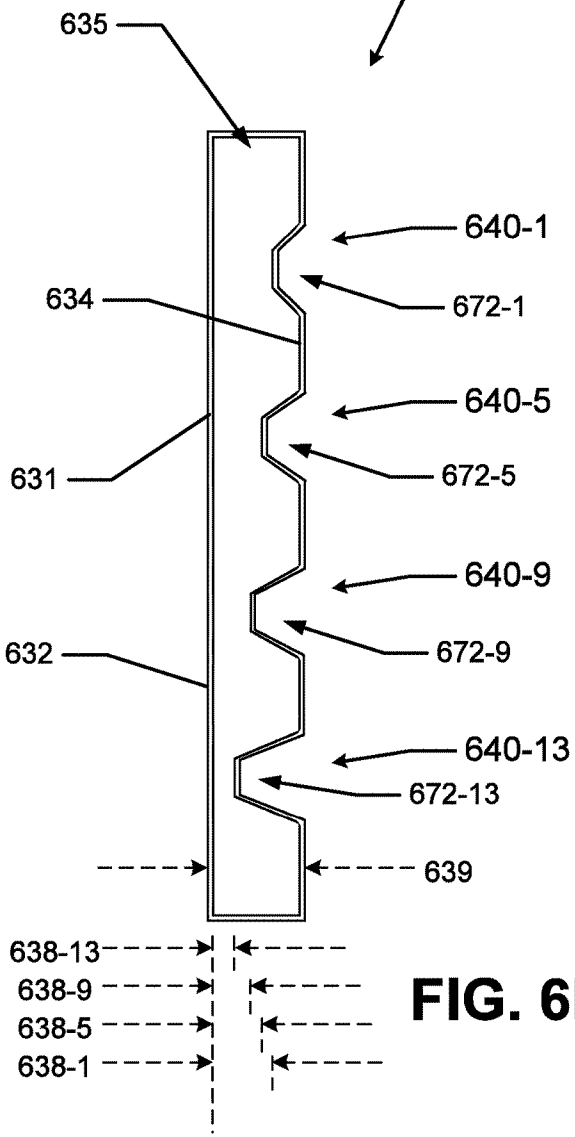
FIGS. 6A and 6B show various views of yet another HX tube in accordance with certain example embodiments.
Figure 6A:
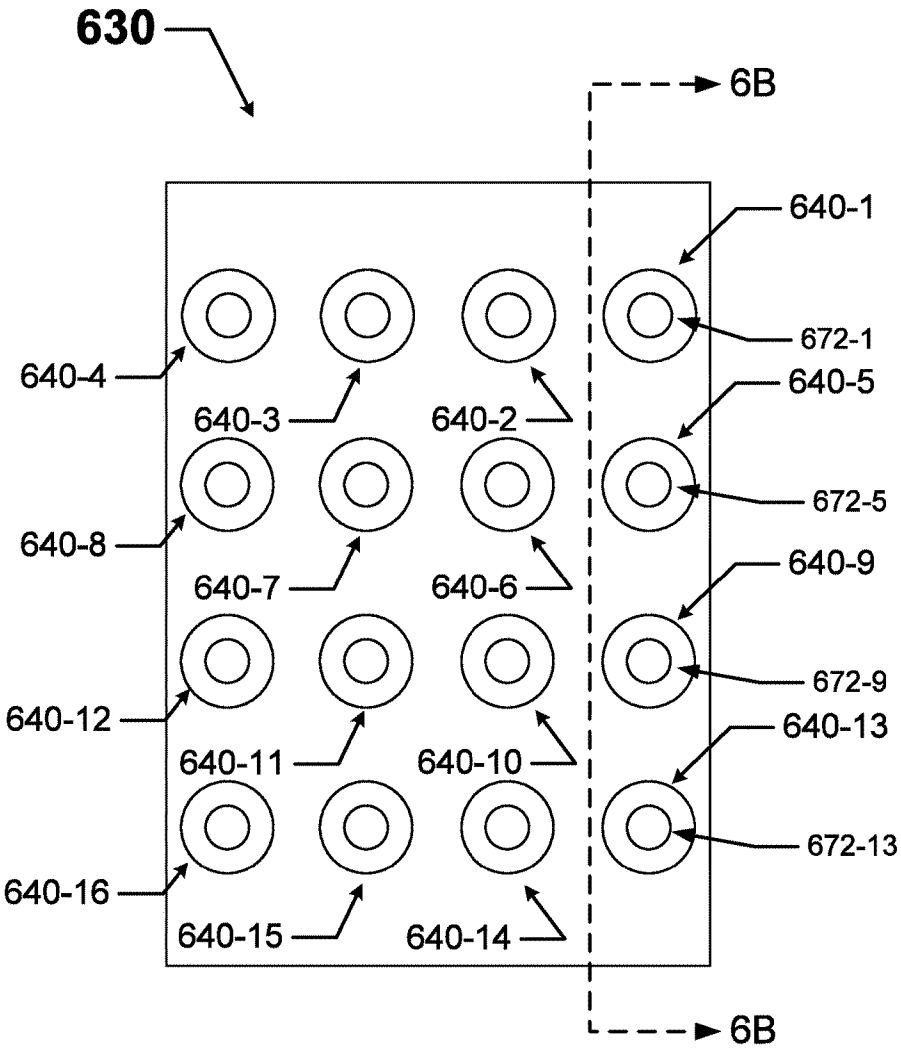

Referring to FIGS. 1A through 4D, the example HX tube 430 of FIGS. 4A through 4D is substantially the same as the HX tube 330 of FIGS. 3A through 3F above, except that the gap 438 within a dimple set 440 at the one location along the length of the HX tube 430 is different compared to the gap 438 between one or more other dimple sets 440 disposed at one or more other locations along the length of the HX tube 430. In this example, the HX tube 430 has a cylindrical shape before any of the dimples 440 are created. In alternative embodiments, the HX tube 430 can have any of a number of configurations (e.g., an elongated (in terms of width) tube sheet (as shown in FIGS. 6A and 6B), a twisted configuration (as shown in FIGS. 5A and 5B below)) and/or cross-sectional shapes (e.g., square, triangle, hexagon).

In this case, the portion of the HX tube 430 of FIGS. 4A through 4D shows twelve dimple sets 440. Dimple set 440-1 is located toward the top end of the HX tube 430. Located adjacent to dimple set 440-1 and downward along the length of the HX tube 430 is dimple set 440-2. Located adjacent to dimple set 440-2 and downward along the length of the HX tube 430 is dimple set 440-3. Located adjacent to dimple set 440-3 and downward along the length of the HX tube 430 is dimple set 440-4. Located adjacent to dimple set 440-4 and downward along the length of the HX tube 430 is dimple set 440-5. Located adjacent to dimple set 440-5 and downward along the length of the HX tube 430 is dimple set 440-6. Located adjacent to dimple set 440-6 and downward along the length of the HX tube 430 is dimple set 440-7.

Located adjacent to dimple set 440-7 and downward along the length of the HX tube 430 is dimple set 440-8. Located adjacent to dimple set 440-8 and downward along the length of the HX tube 430 is dimple set 440-9. Located adjacent to dimple set 440-9 and downward along the length of the HX tube 430 is dimple set 440-10. Located adjacent to dimple set 440-10 and downward along the length of the HX tube 430 is dimple set 440-11. Located adjacent to dimple set 440-11 and downward along the length of the HX tube 430 is dimple set 440-12.

In this case, each dimple set 440 is horizontally offset around the outer perimeter of the HX tube 430 with respect to each adjacent dimple set 440 along the length of the wall 431 by approximately 90°. Put another way, every other dimple set 440 penetrates the wall 431 of the HX tube 430 from the same directions, and every adjacent dimple set 440 penetrates the wall 431 of the HX tube 430 from directions that vary by approximately 90°. In alternative embodiments, the horizontal offset between adjacent dimple sets 440 can be 0°, in which case all dimple sets 440 are aligned with each other along the length of the HX tube 430. In yet other alternative embodiments, the horizontal offset between adjacent dimple sets 440 can be any angle other than 90°.

Also, while the horizontal offset between adjacent dimple sets 440 in this example is consistent along the length of the HX tube 430, the horizontal offset between adjacent dimple sets 440 can vary along the length of the HX tube 430. For example, the horizontal offset between dimple set 440-2 and dimple set 440-3 can be approximately 90°, the horizontal offset between dimple set 440-3 and dimple set 440-4 can be approximately 0°, and the horizontal offset between dimple set 440-4 and dimple set 440-4 can be approximately 45°.

The vertical spacing between adjacent dimples 440 in this case is substantially the same along the length of the HX tube 430. For example, dimple set 440-5 and dimple set 440-6 (as measured from the center of their dimples) is vertical distance 437-5, and dimple set 440-6 and dimple set 440-7 is vertical distance 437-6. In this example, vertical distance 437-5 and vertical distance 437-6 are substantially the same as each other. In alternative embodiments, the vertical distance 437 between adjacent dimple sets 440 can vary along the length of the HX tube 430.

A dimple set 440 can have any of a number of dimples 472 that are disposed at the same location (height) along the length of the HX tube 430. In this case, each dimple set 440 for the HX tube 430 of FIGS. 4A through 4D has two dimples 472. In alternative embodiments, a dimple set 440 can have a single dimple 472. In still other alternative example embodiments, a dimple set 440 can have three or more dimples 472. The number of dimples 472 in one dimple set 440 of the HX tube 430 can differ from the number of dimples 472 in at least one other dimple set 440 of the HX tube 430.

When a dimple set 440 has multiple dimples 472, those dimples 472 can be arranged in any of a number of ways with respect to each other. For example, in this case, the two dimples 472 in each dimple set 440 are disposed on opposite sides of the wall 431 of the HX tube 430 (equidistantly from each other along the outer perimeter of the wall 431 of the HX tube 430). In alternative embodiments, the arrangement of dimples 472 in one dimple set 440 can differ from the arrangement of dimples 472 in at least one other dimple set 440 of the HX tube 430.

The dimples 472 themselves can have any of a number of shapes. For example, the dimple 472 in each of the dimple sets 440 is substantially circular. Other shapes of a dimple 472 can include, but are not limited to, an oval, a square, a hexagon, a line segment, and an arc. While the shape of each dimple 472 in this example is the same, in alternative embodiments, the shape of a dimple 472 can have a different shape from at least one other dimple 472 in the HX tube 430. The shape of one dimple 472 in a dimple set 440 can vary from the shape of at least one other dimple 472 in that dimple set 440.

As discussed above, the principal difference between the example embodiment of the HX tube 430 shown in FIGS. 4A through 4D and the HX tube 330 of FIGS. 3A through 3F that is currently used in the art is that the distance 438 (the gap 438) between dimples 472 in one dimple set 440 differ from the distance 438 between dimples 472 of at least one other dimple set 440 of the HX tube 430. For example, as shown in FIG. 4B, the two dimples 472-2 of dimple set 440-2 are separated by a distance 438-2 (as measured at the inner surface 434 of the wall 431 of the HX tube 430 where the opposing dimples 472-2 are disposed).

Also, as shown in FIG. 4C, the two dimples 472-6 of dimple set 440-6 are separated by a distance 438-6 (as measured at the inner surface 434 of the wall 431 of the HX tube 430 where the opposing dimples 472-6 are disposed). Finally, as shown in FIG. 4D, the two dimples 472-10 of dimple set 440-10 are separated by a distance 438-10 (as measured at the inner surface 434 of the wall 431 of the HX tube 430 where the opposing dimples 472-10 are disposed).

In this example, distance 438-2, distance 438-6, and distance 438-10 are all different from each other. Specifically, distance 438-2 is greater than distance 438-6, which is greater than distance 438-10. For example, distance 438-2 can be 0.25 inches, distance 438-6 can be 0.2 inches, and distance 438-10 can be 0.04 inches. There can be many variations as to how the various distances 438 can vary with respect to each other. In this case, the distances 438 decrease from the top of the HX tube 433, where fluid is introduced into the cavity 435, to the bottom of the HX tube 433, where the fluid leaves the cavity 435. Alternatively, the distances 438 can increase from top to bottom of the HX tube 430.

There can also be a combination of trends in the variations in distances 438 along the length of the HX tube 430. For example, the distances 438 can decrease from the top to the middle of the HX tube 430, and then increase from the middle to the bottom of the HX tube 430. Conversely, the distances 438 can increase from the top to the middle of the HX tube 430, and then decrease from the middle to the bottom of the HX tube 430. When distances 438 vary along the length of the HX tube 430 in example embodiments, there can be only one distance 438 that varies. For example, distances 438-1 through 438-6 can be identical to each other, and distances 438-7 through 438-12 can be identical to each other but different from distances 438-1 through 438-6. Those of ordinary skill in the art will appreciate that there are many other variations that can exist to arrive at an example embodiment.

Example HX tubes 430 that have differing (e.g., decreasing graduation) distances 438 of the dimple sets 440 along its length promote more uniform temperature distribution across and along the HX tubes 430. In addition, varying the distances 438 of the dimple sets 440 improves the pressure drop across the HX tube 430. The embodiments described herein can be called "progressive dimpling". These designs not only improve performance of the HX tube 430, but the designs also improve the reliability and useful life of the HX tube 430. For example, when the distances 438 toward the top of the HX tube 430 are larger than the distances 438 toward the bottom of the HX tube 430, the pressure drop of the whole HX tube 430 (as well as the entire heat exchanger) can be reduced.

By having a larger effective area (e.g., larger distances 438) along the first several dimples 440 toward the top of the HX tube 430, where the temperature of the fluid (e.g., flue gas) that flows through the cavity 435 of the HX tube 430 is the highest, the pressure drop of the HX tube 430 is reduced by impacting the velocity of the fluid and the volume of the cavity 435. Also, having a larger effective area in the cavity 435 along the first several dimples 440 reduces the heat intensity on the material of the HX tube 430, reduces the maximum metal temperatures on the HX tube 430, and reduces the thermal stresses on the HX tube 430.

When a heat exchanger uses a tube assembly (i.e., has a number of HX tubes 430), one HX tube 430 can have the same, or different, characteristics (e.g., number of dimples, location of dimples, slope of dimples, distance between adjacent dimples, dimple angle between adjacent dimples, gap between dimples in a dimple set) compared to the characteristics of one or more of the other HX tubes in the tube assembly.

Example embodiments alter both the inner surface 434 and the outer surface 432 of the example HX tubes (e.g., HX tube 430) described herein. By varying the distance 438 between the one or more dimples 472 in two or more dimple sets 440, the improvement in pressure drop increases significantly. As a result, heat transfer devices that use example HX tubes (e.g., HX tube 430) can use a less powerful blower, pump, or other similar device that injects fluid into the cavity (e.g., cavity 435) of the HX tube. This, in turns, results in reduced equipment cost of the heat transfer device, as well as reduced energy usage of the resulting heat transfer device.

Another benefit of having varying distances between dimple sets in an example HX tube (e.g., HX tube 430) is more a uniform temperature distribution throughout the HX tube, which reduces the thermal stresses imposed on the HX tube and enhances the life and durability of the HX tube. As stated above, an example HX tube can have any of a number of other configurations. Two examples are shown below with respect to FIGS. 5A through 6B.

FIGS. 5A and 5B shows various views of another HX tube 530 in accordance with certain example embodiments. Specifically, FIG. 5A shows a side view of the HX tube 530. FIG. 5B shows a semi-transparent cross-sectional side view of the HX tube 530. Referring to FIGS. 1A through 5B, the HX tube 530 of FIGS. 5A and 5B is substantially the same as the HX tube 430 of FIGS. 4A through 4D, except as described below.

In this case, rather than starting as a cylindrical tube before dimples 540 or other similar features are added to the HX tube 530 to alter the cylindrical shape of the cavity 535 formed along the length of the HX tube 530, as was the case with the HX tube 430 of FIGS. 4A through 4D, the HX tube 530 of FIGS. 5A and 5B, having outer diameter 539, is twisted about an axis formed along the length of the HX tube 530. In addition, pairs of opposing crimps are made at regular intervals (distance 537) along the length of the HX tube 530, forming pairs of opposing dimples 540 that are directed toward (e.g., separated by gap 538) each other.

In this case, it takes eight sets of adjacent dimples 540 along the length of the HX tube 530 for the pattern to repeat (i.e., for a dimple set to rotate one full turn, or) 360°. As such, the dimple angle formed between adjacent sets of dimples 540 along the length of the HX tube 530 in this example is approximately 22.5°. Also, the slope of the dimples 540 in this case, measured by distance 543, is such that more of the outer surface 532 is deformed by each dimple 540 relative to the slope of the dimples 540 of FIGS. 3A through 3F.

FIGS. 6A and 6B show various views of yet another HX tube 630 in accordance with certain example embodiments. Specifically, FIG. 6A shows a front view of the HX tube 630. FIG. 6B shows a cross-sectional side view of the HX tube 630. Referring to FIGS. 1A through 6B, the HX tube 630 of FIGS. 6A and 6B is substantially the same as the HX tube 430 of FIGS. 4A through 4D, except as described below.

In this case, rather than starting as a cylindrical tube, as is the case with the HX tube 430 of FIGS. 4A through 4D, the HX tube 630 in this case is an elongated sheet. With this elongated configuration of the wall 631 of the HX tube 630, the dimple sets 640 are arranged in a 4×4 matrix. Specifically, dimple set 640-1, dimple set 640-2, dimple set 640-3, and dimple set 640-4 are arranged in a row, right to left (when looking at FIG. 6A) toward the top of the HX tube 630. Disposed below this first row of dimple sets 640-1 through 640-4 is a second row that includes dimple set 640-5, dimple set 640-6, dimple set 640-7, and dimple set 640-8.

Disposed below this second row of dimple sets 640-5 through 640-8 is a second row that includes dimple set 640-9, dimple set 640-10, dimple set 640-11, and dimple set 640-12. Finally, disposed below this third row of dimple sets 640-9 through 640-12 is a second row that includes dimple set 640-13, dimple set 640-14, dimple set 640-15, and dimple set 640-16. The arrangement also has four columns, with the far right column including dimple set 640-1, dimple set 640-5, dimple set 640-9, and dimple set 640-13. The next column over to the left includes dimple set 640-2, dimple set 640-6, dimple set 640-10, and dimple set 640-14. The next column over to the left includes dimple set 640-3, dimple set 640-7, dimple set 640-11, and dimple set 640-15. Finally, the column on the far right includes dimple set 640-4, dimple set 640-8, dimple set 640-12, and dimple set 640-16.

Each dimple set 640 of the HX tube 630 of FIGS. 6A and 6B includes only a single dimple 672. The dimple 672 of each dimple set 640 of the HX tube 630 is substantially circular when viewed from the front. Again, these dimples 672 can have any of a number of other shapes, and the shape of one dimple 672 can be the same as, or different than, the shape of one or more other dimples 672 of the HX tube 630.

Because there is only a single dimple 672 for each dimple set 640, the distance 638 is measured from the inner surface 634 of the rear of the wall 631 to the inner surface 634 of the front of the wall 631 where the corresponding dimple 672 is located. For example, as shown in FIG. 6B, distance 638-1 formed by dimple set 640-1 is the distance of the inner surface 634 of the front of the wall 631 where dimple 672-1 is formed to the inner surface 634 of the adjacent rear of the wall 631. Distance 638-5 formed by dimple set 640-5 is the distance of the inner surface 634 of the front of the wall 631 where dimple 672-5 is formed to the inner surface 634 of the adjacent rear of the wall 631.

Distance 638-9 formed by dimple set 640-9 is the distance of the inner surface 634 of the front of the wall 631 where dimple 672-9 is formed to the inner surface 634 of the adjacent rear of the wall 631. Finally, distance 638-13 formed by dimple set 640-13 is the distance of the inner surface 634 of the front of the wall 631 where dimple 672-13 is formed to the inner surface 634 of the adjacent rear of the wall 631. These distances 638 are all smaller than the distance 639 between the front of the wall 631 and the rear of the wall 631 without dimples. In this case, distance 638-1 is greater than distance 638-5, which is greater than distance 638-9, which is greater than distance 638-13.

The distance 638 in one row can be the same for all dimple sets 640 in the row. Alternatively, the distance 638 of one dimple set 640 in a row can be different than the distance 638 of at least one other dimple set 640 in the row. Also, while the distance 638 within the far left column in this case is shown as gradually decreasing from the top to the bottom of the HX tube 630, the distance 638 of one dimple set 640 can be greater than, substantially the same as, or less than the distance 638 of an adjacent dimple set 640.

An example HX tube described herein have a cavity formed by an inner wall surface of the HX tube. In example embodiments, a HX tube can be crimped in multiple locations to form multiple dimples. The cavity of an example HX tube is continuous along the length of the HX tube, even with multiple dimples. In certain example embodiments, there is a dimple set (which can have one or more dimples) disposed at a same location along the height of the HX tube, and each dimple of a dimple set can extend within the cavity of the HX tube toward each other or another inner surface of the wall of the HX tube. At least some of the one or more dimples of a dimple set of an example HX tube do not make contact with each other or another inner surface of the wall of the HX tube within the cavity.

In addition, the distance that separates the one or more dimples of one dimple set within the cavity of the HX tube are different from the distance that separates the one or more dimples of at least one other dimple set within the cavity of the HX tube. This variation in distance between dimple sets provides a number of benefits. For instance, example embodiments can provide improved and uniform heat transfer across and along the HX tube. As another example, HX tubes described herein lead to improved pressure drop along the length of the HX tube. As yet another example, HX tubes described herein have higher efficiency (e.g., requires a lower horsepower motor or other equipment to force fluid through the HX tube). Other benefits of using example embodiments can include, for instance, lower energy consumption (e.g., by virtue of having a lower horsepower motor or other similar equipment), lower costs, and less waste. Example HX tubes can further allow a heat exchanger to comply with any applicable standards and/or regulations. Example embodiments can be mass produced or made as a custom order.

Accordingly, many modifications and other embodiments set forth herein will come to mind to one skilled in the art to which example HX tubes pertain having the benefit of the teachings presented in the foregoing descriptions and the associated drawings. Therefore, it is to be understood that example HX tubes are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A tube for a thermal transfer device, wherein the tube comprises:

a wall having a length and comprising an inner surface and an outer surface, wherein the inner surface forms a cavity;

at least one first dimple pressed into the wall toward the cavity at a first location along the length of the wall, wherein the inner surface of the wall at the at least one first dimple is separated by a first distance from the inner surface of the wall across the cavity opposite the at least one first dimple; and at least one second dimple pressed into the wall toward the cavity at a second location along the length of the wall, wherein the inner surface of the wall at the at least one second dimple is separated by a second distance from the inner surface of the wall across the cavity opposite the at least one second dimple, at least one third dimple pressed into the wall toward the cavity at a third location along the length of the wall, wherein the inner surface of the wall at the at least one third dimple is separated by a third distance from the inner surface of the wall across the cavity opposite the at least one third dimple, wherein the second location is between the first location and the third location, wherein the cavity is configured to receive a fluid that flows continuously along a length of the wall, and wherein the first distance and the third distance are each greater than the second distance.

2. The tube of claim 1, wherein the at least one first dimple is a first pair of dimples.

3. The tube of claim 2, wherein the first pair of dimples are disposed on opposite sides of the wall.

4. The tube of claim 3, wherein the at least one second dimple is a second pair of dimples.

5. The tube of claim 4, wherein the second pair of dimples are disposed on opposite sides of the wall.

6. The tube of claim 5, wherein the first pair of dimples and the second pair of dimples are aligned with each other when viewed along the length of the wall.

7. The tube of claim 5, wherein the first pair of dimples and the second pair of dimples are horizontally offset with respect to each other along the outer surface of the wall when viewed along the length of the wall.

8. The tube of claim 7, wherein the first pair of dimples and the second pair of dimples are horizontally offset with respect to each other along the length of the wall by approximately 90°.

9. The tube of claim 1, wherein the first location is disposed toward a first end of the wall, wherein the first end is configured to receive the fluid that flows through the cavity.

10. The tube of claim 1, wherein the second location is disposed halfway between the first location and the third location.

11. The tube of claim 1, wherein the second distance is zero.

12. The tube of claim 1, wherein the third distance is less than the first distance and greater than the second distance.

13. The tube of claim 1, wherein the wall is rotationally twisted along its length.

14. The tube of claim 1, wherein the wall has an axis that forms along its length, wherein the axis is linear.

15. The tube of claim 1, wherein each dimple of the at least one first dimple is circular in shape at its base.

16. The tube of claim 1, wherein the at least one first dimple is a trio of dimples that are rotationally offset 120 degrees relative to each other.

17. The tube of claim 1, wherein the wall is cylindrical before creation of the at least one first dimple, the at least one second dimple, and the at least one third dimple.

18. The tube of claim 1, wherein the wall further comprises a first end and a second end, wherein the at least one first dimple, the at least one second dimple, and the at least one third dimple are disposed between the first end and the second end, wherein the first end is configured to be disposed within a first aperture in a first tube sheet of the thermal transfer device, and wherein the second end is configured to be disposed within a second aperture in a second tube sheet of the thermal transfer device.

19. The tube of claim 1, wherein each dimple of the at least one first dimple is an arc in shape at its base.

20. The tube of claim 1, wherein each dimple of the at least one first dimple comprises a different shape at its base from each dimple of the at least one second dimple at its base.

* * * * *